United States Patent [19]

Baxter

[11] Patent Number: 4,699,277

[45] Date of Patent: Oct. 13, 1987

[54] COMPRESSION SYSTEM FOR MICROFICHE FILES AND THE LIKE

[76] Inventor: Kenneth W. Baxter, 3540 Valhalla Dr., Burbank, Calif. 91505

[21] Appl. No.: 916,829

[22] Filed: Oct. 9, 1986

[51] Int. Cl.[4] ..... A47F 7/00

[52] U.S. Cl. ..... 211/51; 211/11

[58] Field of Search ..... 211/51, 11, 184, 10, 211/49.1, 50, 59.3

[56] References Cited

U.S. PATENT DOCUMENTS

| | | | |
|---|---|---|---|
| 76,872 | 4/1868 | Woodruff et al. | 211/51 |
| 290,498 | 12/1883 | Tucker | 211/51 X |
| 378,062 | 2/1888 | Baker | 211/51 |
| 451,310 | 4/1891 | Schultze | 211/51 |
| 475,212 | 5/1892 | Fowler | 211/51 |
| 764,645 | 7/1904 | Van Horn | 211/51 |
| 1,113,182 | 10/1914 | Avery | 211/11 X |
| 1,893,186 | 1/1933 | Thomas, Jr. et al. | 211/184 X |
| 2,895,485 | 7/1959 | Myers | 211/51 |

*Primary Examiner*—Ramon S. Britts
*Assistant Examiner*—Sarah A. Lechok Eley
*Attorney, Agent, or Firm*—Robert Louis Finkel

[57] ABSTRACT

A system for controllably compressing a plurality of microfiche in a file tray comprises a flat compressor having a rigid upper transverse portion and a flexible, resilient lower transverse portion. A mounting mechanism mounts the compressor to a pair of rails extending lengthwise of the tray on either side of the microfiche for sliding motion lengthwise of the holder and permits the compressor to be inclined for access to the units. Cam means on the mounting mechanism releasably clamp the mounting mechanism to the rails when the compressor is rotated into a vertical position.

10 Claims, 8 Drawing Figures

COMPRESSION SYSTEM FOR MICROFICHE FILES AND THE LIKE

BACKGROUND OF THE INVENTION

1. Field of the Invention

This invention relates to file systems, and especially to trays, drawers, and other holders for filing individually removable microfiche and the like. More particularly it relates to means for releasably compressing the microfiche files in such holders for compact storage.

2. Prior Art

Typically, microfiche, microfilm aperture cards, computer floppy discs, and the like are stored in rigid open-top trays or drawers. Various systems have been devised for use with such trays and drawers to facilitate the manual insertion and removal of the individual information bearing units. U.S. Pat. Nos. 3,114,459 to Kersting and 3,347,393 to Frey are examples of such systems. Generally these systems incorporate means for applying force to compress some or all of the units into compact packs when they are not in use.

In some of these devices the compression means are adapted to be inclined at an angle to an imaginary vertical plane as well as being moveable longitudinally of the file tray or drawer to afford the user easy access to the individual units.

Some compressors of this type take the form of rigid end plates mounted for rotation about a horizontal axis extending transversely of the tray or drawer. Others employ one or more transversely mounted rigid tracks or railss adapted for movement longitudinally of the holder.

While these prior art compression mechanisms serve their intended purposes more or less satisfactorily, they are not without deficiencies. Some do not furnish sufficient compressive force to retain the individual units in place in the event the tray or drawer is accidentally upset. Some furnish adequate restraining force, but are subject to inadvertent release with potentially catastrophic results. Most of them require the use of two hands for their operation, and even with the use of both hands, generally afford the user little control over the amount of force exerted against the individual units. In the case of systems utilizing the compressing means for fanning or separating the individual units, this lack of precise control prevents the user from taking full advantage of the system's capability.

A number of filing systems provide means, such as embossments formed on segregators positioned between the individual units, for fanning or separating the units and enabling the user to examine their contents visually without removing them from the tray or drawer. U.S. Pat. No. 3,913,250 to Arthur T. Spees, and my U.S. Pat. No. 4,231,175 are illustrative of systems of this type. Such systems likewise generally include means for compressing the information bearing units, and, not surprisingly, these suffer from similar deficiences.

In an effort to design an improved compression mechanism for my patented file system, I developed and tested a compressor assembly comprising two rigid rectangular plates joined at their respective lower and upper edges by means of a piano hinge and maintained in planar alignment by means of a torsion spring mounted to the hinge pin. Mounting means secured to the side edges of the upper plate near its lower end permitted the "split" compressor to be mounted to a pair of axially aligned rods attached to the inside of the side walls of a file drawer for rotation about an imaginary horizontal axis transverse to the drawer.

The mounting means were designed to clamp to the supporting rods when the compressor was in a vertical position, and to permit the entire assembly to slide longitudinally of the drawer on the rods when the compressor was rotated out of the vertical plane.

In principle, sliding the compressor toward, say, a set of microfiche standing at one end of the drawer would bring the bottom edge of the lower plate into contact with the lower portion of the closest microfiche. Advancing the compressor further would urge the lower edges of the microfiche together.

When the force required to overcome the collective resistance offered by the individual units exceeded the torque exerted by the torsion spring, the lower plate would rotate about the axis of the piano hinge until the face of the lower plate abutted the face of the closest fiche. Still further advancement of the compressor would cause the lower plate to urge the fiche successively into vertical alignment and then into compression.

At that point the lower plate of the compressor would be aligned vertically as well, and continued advancement of the compressor would cause the upper plate to rotate about the piano hinge axis into vertical alignment with the lower plate, thereby applying maximum compressive force to the compacted microfiche and simultaneously locking the compressor assembly in place.

In actuality, however, the hinged compressor proved to have certain drawbacks. Notably, for reasons not entirely clear, but probably associated with the nature of torsion springs, the action of the assembly was neither as fluid or as precisely controllable as had been anticipated.

In an attempt to overcome these deficiencies I developed and tested a compressor consisting of a thin flexible resilient sheet of plastic material fastened by means of rivets to a rigid backing plate which extended across the upper two thirds of the sheet and served as a stiffener. As in the earlier assembly, self-locking mounting means secured to the rigid plate near its lower end supported the compressor on a pair of rails and provided for both longitudinal movement and rotation of the compressor.

While this construction was an improvement over the earlier one, it still suffered, albeit to a lesser extent, from the previously mentioned deficiencies encountered with the split compressor. Apparently, the resilient strip joined to the rigid plate with a portion of the strip extending beyond the plate was the functional equivalent of a pair of rigid plates joined by a hinge and retained by a torsion spring.

Based on the foregoing experience I have now constructed a compressor which avoids the problems encountered with the earlier designs. With this new compressor, the invention disclosed here represents a novel compression system that can be adapted advantageously to virtually any microfiche holder and that avoids the deficiencies mentioned earlier which are inherent in the prior art file systems.

One object of the invention is to provide compression means capable of applying sufficient force to the contents of the tray or drawer to retain the contents in the tray or drawer even if it should be upset.

Another object is to provide a compression mechanism for file trays and drawers which can be operated readily with one hand.

Yet another object is to provide compression means which allow the user to control the force applied to the individual units smoothly and with precision regardless of the number of units or their location in the tray or drawer.

Still another object is to provide compression means which will not interfere with the operation of prior art fanning and separating systems of the type previously mentioned.

Other objects and features of the invention and its advantage over the prior art will become apparent to the reader from the following detailed description of several of its preferred embodiments as illustrated in the accompanying set of drawings.

BRIEF DESCRIPTION OF THE INVENTION

The preferred embodiment of the present invention differs from my two previously mentioned earlier systems in the construction of the compressor. As in those embodiments, the compressor is mounted by self-locking mounting means to a pair of elongated parallel longitudinally aligned rails for controlled rotation about a transverse axis and sliding motion longitudinal of the tray or drawer.

In this instance, however, rather than being formed in two sections joined at their respective lower and upper edges, the compressor comprises a single plate of resilient material, preferably of reduced thickness (and thus greater resilience) across the full width of its lower portion.

This distinction over the prior compressor construction, while seemingly slight, has been found to make an unexpected, marked improvement in the operation of the compressor assembly and allows the assembly to satisfy all of the aforementioned objects.

DETAILED DESCRIPTION OF THE INVENTION

Figure 1:
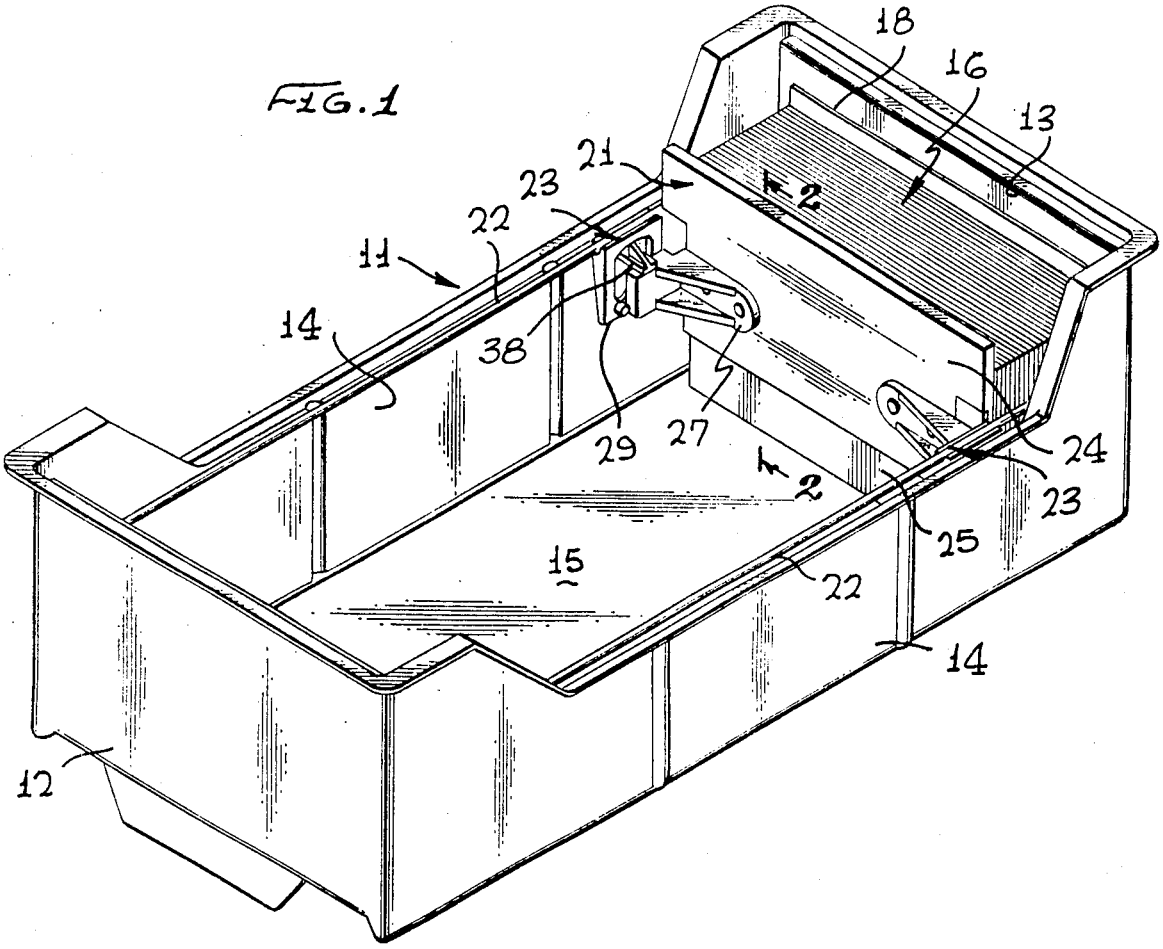
FIG. 1 is a top perspective view of a typical file tray illustrating a preferred embodiment of the subject invention with a number of microfiche held in compression.

The file tray 11 illustrated in FIG. 1 is formed with end walls 12, 13, side walls 14, and bottom 15 adapted to receive and hold a deck of flexible microfiche cards 16 in a row, one behind another. Typically such cards are rectangular and have top, bottom, and side edges. Often they are provided with flexible protective jackets. In some filing systems they are separated by embossed segregators or index cards. My invention will work equally well with any and all of these configurations.

An adjustable retaining plate 18, which is moveable longitudinally of tray 11, serves as a backstop for cards 16 and allows the user to position them within the tray 11 for convenient viewing and manipulation.

The invention comprises three elements: the compressor 21; a pair of elongated parallel rails 22, in this instance a pair of rigid steel rods attached at their respective ends to the end walls 12, 13 of tray 11 and extending longitudinally of tray 11 along the sides of fiche 16; and mounting mechanism 23 by means of which compressor 21 is mounted to rails 22.

Compressor 21 is a unitary, unbroken sheet of suitable material, such as polypropylene, polyethelene, polyvinyl plastic, or the like. Preferrably, the upper transverse portion 24 of compressor 21 is of sufficient thickness to be substantially rigid. The lower transverse portion 25 is of such thickness as to be resilient throughout its width.

Figure 2:
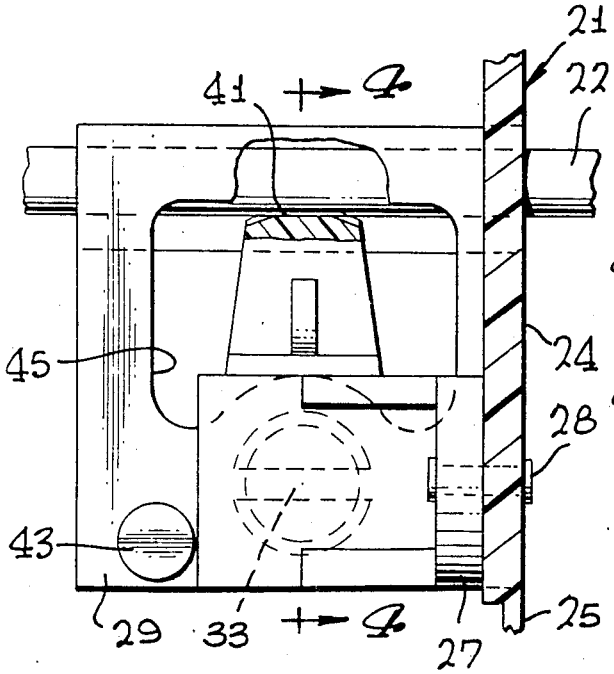
FIG. 2 is an enlarged partial interior elevation taken in the direction 2—2 of FIG. 1 with portions cut away to illustrate one of the mounting mechanisms in its locked position.
Figure 3:
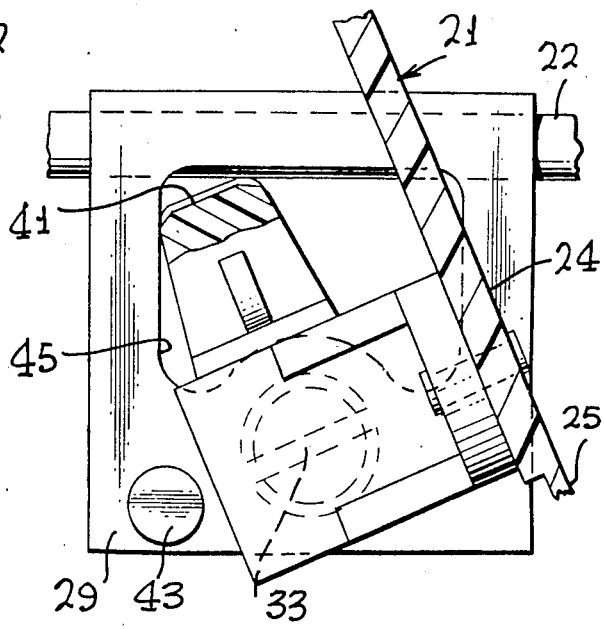
FIG. 3 is an enlarged partial interior elevation taken in the direction 2—2 of FIG. 1 illustrating the mounting mechanism of FIG. 2 in its unlocked position.
Figure 4:
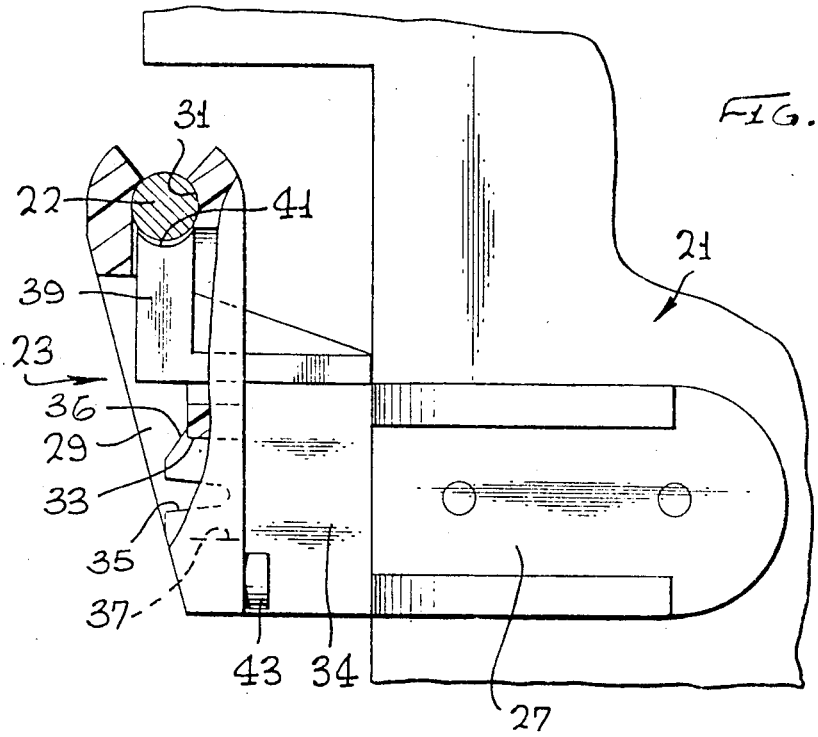
FIG. 4 is a partial sectional view taken in the direction 4—4 through the mounting mechanism of FIG. 2.

Referring to FIGS. 2–4, mounting mechanism 23 comprises a support bracket 27 secured to compressor 21 near the lower edge of rigid upper portion 24 thereof by conventional means, such as rivets 28, and a slide bracket 29. A channel 31 formed in the upper end of slide bracket 29 is adapted to receive and retain rail 22 in snug engagement for smooth, unimpeded sliding axial movement thereon.

Support bracket 27 and slide bracket 29 are formed of Nylon or other suitable durable resilient plastic material.

A projection formed on the outer end 34 of support bracket 27 serves as an axle 33. Axle 33 is journalled through the wall of slide bracket 29 and permits compressor 21 to be rotated about an imaginary axis transverse to tray 11 and perpendicular to its side walls 14. Compressor 21 is offset from this axis of rotation by the spacing separating the plane containing compressor 21 from the axis of axle 33.

A slot 35 formed in axle 33 allows its enlarged head 36 to be inserted through opening 37 in the wall of slide bracket 29, and on expansion of axle 33 head 36 retains slide bracket 29 securely mounted to support bracket 27.

Mounting means 23 includes clamping means 38 which, as will be explained, serves a dual purpose. In this embodiment clamping means 38 takes the form of an upwardly directly arm 39 formed on the outer end 34 of support bracket 27. Arm 39 has a groove 41 in its upper end, As seen most clearly in FIGS. 2 and 3, a boss 43 formed on the inner face of slide bracket 29 limits the rotation of support bracket 27 in one direction to a first position in which compressor 21 is vertical. In this first position, shown in FIG. 2, the walls of groove 41 engage the underside of rail 22 in clamping frictional contact, effectively locking compressor 21 in the vertical first position and preventing slide bracket 29 from moving axially of rail 22.

The rotation of arm 39 around axle 33 in the direction away from microfiche 16 releases its frictional exgagement with rail 22. Face 45 on slide bracket 29 serves as a stop for arm 39 and limits the rotation of compressor 21 to a predetermined second position, as shown in FIG. 3.

By virtue of this construction the mounting mechanism 23 affords compressor 21 freedom of both rotational and longitudinal movement in all but its vertical first positon, and in that position mechanism 23 serves as a releasable clamp, resisting both rotational and longitudinal movement of compressor 21.

Figure 5A:
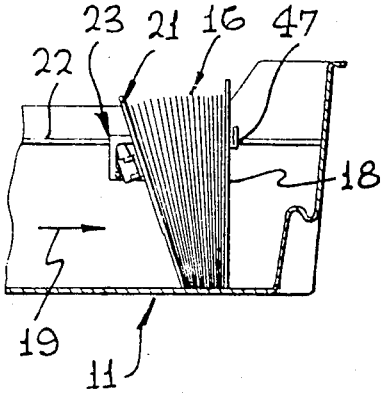
FIG. 5A is a reduced side cutaway view of a tray similar to the tray of FIG. 1 showing the compressor in loose engagement with a group of microfiche.
Figure 5B:
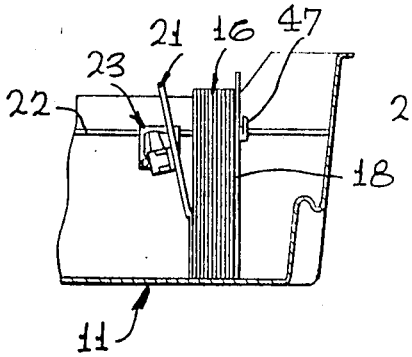
FIG. 5B is a side cutaway view of the tray of FIG. 5A showing the microfiche under partial compression.
Figure 5C:
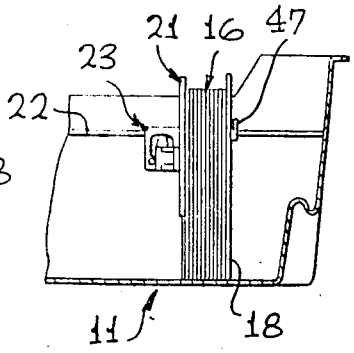
FIG. 5C is a reduced side cutaway view of the tray of FIG. 5A showing the compressor locked in position with the microfiche under maximum compression.

FIGS. 5A–5C illustrate the operation of a filing system embodying the invention. As seen in FIG. 5A, manually operated sliding clamps 47 permit retaining plate 18 to be moved along rails 22 to position the deck of microfiche cards 16 in tray 11 for easy reach by the user.

With compressor 21 inclined in the aforementioned second position and spaced from plate 18, as shown in FIG. 5A, fiche 16 may readily be "fanned" for visual inspection or removal. The spacing of compressor 21 from plate 18 determines the angular separation of the fiche. By grasping the exposed upper portion 24 of compressor 21, the user may move the compressor in either direction along rails 22 with ease, thereby controlling the the distance between the upper edges of successive fiche.

Sliding compressor 21 in the direction indicated by arrow 49 compresses the lower ends of fiche 16 and presents the lower portion 25 of compressor 21 with a resisting force. Further motion in the same direction against this force causes the resilient lower portion 25 of compressor 21 to bend downwardly, and simultaneously urges compressor 21 to rotate about axle 33 toward a more nearly vertical position, as shown in FIG. 5B.

As seen in FIG. 5B, while the force exerted by the lower portion 25 of compressor 21 has compressed the fiche 16 into a fairly compact deck, since the upper portion 24 of compressor 21 is not yet vertical, arm 39 has not yet engaged rail 22. Thus sliding bracket 29 is still freely moveable and compressor 21 is still freely rotatably. The user thus continues to have complete control over the positioning of compressor 21, and therefore, over the precise amount of compressive force applied to the deck of fiche.

In FIG. 5C compressor 21 has been rotated into its previously described vertical position. Here arm 39 is in clamping engagement with rail 22, and slide bracket 29 and arm 39 are immobilized. That is, the configuration of groove 41 at the top of arm 39 offers a resilient force in opposition to rotation of arm 39 which effectively locks the entire slide bracket assembly in place. The geometry and characteristics of the material of the assembly, and particularly of arm 39, determine the amount of force the user must exert at the upper edge of compressor 21 to release the assembly.

Figure 6:
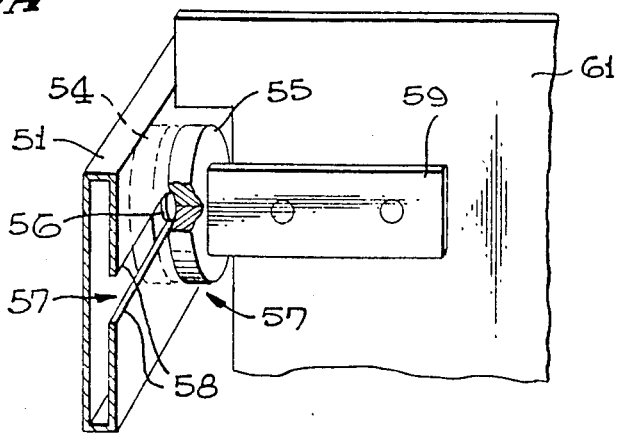
FIG. 6 is a partial top rear perspective view of an alternative means for mounting the compressor to a holder with portions cut away for illustrative purposes.

FIG. 6 is illustrative of one of a number of alternative embodiments of my invention. In this construction the rail takes the form of an elongated "C"-shaped channel 51. The mounting mechanism comprises a slide assembly 52 which includes a pair of plates, here in the form of disks 54, 55.

Disk 54 is adapted for sliding motion within channel 51 and is connected to disk 55 by a spacer 56. Spacer 56 passes through the slot 57 in the side of channel 51 and has a cam-shaped cross-section which is adapted for frictional clamping engagement of the edges 58 of slot 57 when support bracket 59 and compressor 61 are in a vertical position. Spacer 56 is configured to limit the rotation of compressor 61 in one direction to the vertical position, and in the opposite direction to some predetermined inclined position.

While I have described my invention in terms of alternative preferred embodiments, it is not to be construed as limited to those embodiments, and they are to be regarded as illustrative rather than restrictive. It is my intention by this specification to cover any and all variations of the examples I have chosen for purposes of the disclosure, which do not depart from the spirit and scope of the following claims.

I claim as my invention:

1. A compression system for controllably compressing a plurality of information-bearing cardlike units upstandingly supported in a row, one behind another, in a holder, the compression system comprising:

a unitary, generally planar compressor having top and bottom edges and comprising a rigid upper transverse portion and a flexible, resilient lower transverse portion;

a pair of elongated parallel rails mounted to the holder and extending longitudinally of said row; and mounting means secured to the compressor intermediate the top and bottom edges of said compressor, said mounting means being mounted to the rails adjacent one end of said row for sliding movement of the compressor longitudinally of said row and for rotation of said compressor about an axis transverse to the holder and perpendicular to the rails between a first position, in which the bottom edge of the compressor is in contact with the nearest one of said units and said compressor is inclined upwardly away from the units, and a second position, in which the compressor is in substantially vertical abutment with the nearest one of said units, said mounting means being adapted to be in releasable frictional clamping engagement with the rails when the compressor is in said second position, whereby simultaneous movement of said compressor longitudinal of said rails in the direction toward said units and rotation of said compressor from said first position into said second position cause said compressor to exert controllable compressive force against said units.

2. The compression system of claim 1, comprising:

slide means slidably mounted to the rails for sliding movement longitudinally thereof;

attachment means secured to the compressor intermediate the top and bottom edges of said compressor and mounted to the slide means; and camming means on the attachment means adapted to be in releasable frictional clamping engagement with the rails when the compressor is in the second position;.

3. The compression system of claim 2, comprising:

a pair of slide brackets slidably mounted to the rails, the attachment means being journalled to the slide brackets for rotation of the compressor about an axis transverse to the holder and perpendicular to the rails between the first and second positions;

arms forced on and extending perpendicularly from the attachment means and adapted to be in releasable frictional clamping engagement with the rails when the compressor is in the second position; and stop means associated with the slide means for limiting rotation of the compressor in the direction of the first position.

4. The compression system of claim 3, comprising:

a groove in the arms adapted to conform closely with the rails adapted for releasable frictional clamping engagement with the rails when the mounting means are in the second position.

5. The compression system of claim 1, comprising:

a pair of elongated parallel "C"-shaped channels having slots in their opposed inwardly facing walls;

pairs of spaced plates, one of each pair of which is positioned within and adapted for sliding movement longitudinally of a channel, and the other of each pair of which is positioned in close sliding abutment with the inwardly facing wall of that channel; and spacers extending through the slots and connecting the plates, each spacer having a cam-shaped cross-section adapted to be in releasable frictional clamping engagement with the edges of its associated slot when the compressor is in the first position.

6. A holder for information-bearing cardlike units, comprising:

holding means for supporting a plurality of such units upstandingly in a row, one behind another;

a unitary, generally planar compressor having top and bottom edges and comprising a rigid upper transverse portion and a flexible, resilient lower transverse portion;

a pair of elongated parallel rails mounted to the holding means and extending longitudinally of said row; and mounting means secured to the compressor intermediate the top and bottom edges of said compressor, said mounting means being mounted to the rails adjacent one end of said row for sliding movement of the compressor longitudinally of said row and for rotation of said compressor about an axis transverse to the holding means and perpendicular to the rails between a first position, in which the bottom edge of the compressor is in contact with the nearest one of said units and said compressor is inclined upwardly away from the units, and a second position, in which the compressor is in substantially vertical abutment with the nearest one of said units, said mounting means being adapted to be in releasable frictional clamping engagement with the rails when the compressor is in said second position, whereby simultaneous movement of said compressor longitudinal of said rails in the direction toward said units and rotation of said compressor from said first position into said second position cause said compressor to exert controllable compressive force against said units.

7. The holder of claim 6, comprising:

slide means slidably mounted to the rails for sliding movement longitudinally thereof;

attachment means secured to the compressor intermediate the top and bottom edges of said compressor and mounted to the slide means; and camming means on the attachment means adapted to be in releasable frictional clamping engagement with the rails when the compressor is in the second position;

8. The holder of claim 7, comprising:

a pair of slide brackets slidably mounted to the rails, the attachment means being journalled to the slide brackets for rotation of the compressor about an axis transverse to the holding means and perpendicular to the rails between the first and second positions;

arms formed on and extending perpendicularly from the attachment means and adapted to be in releasable frictional clamping engagement with the rails when the compressor is in the second position; and stop means associated with the slide means for limiting rotation of the compressor in the direction of the first position.

9. The holder of claim 8, comprising:

a groove in the arms adapted to conform closely with the rails adapted for releasable frictional clamping engagement with the rails when the mounting means are in the second position.

10. The holder of claim 6, comprising:

a pair of elongated parallel "C"-shaped channels having slots in their opposed, inwardly facing walls;

pairs of spaced plates, one of each pair of which is positioned within and adapted for sliding movement longitudinally of a channel, and the other of each pair of which is positioned in close sliding abutment with the inwardly facing wall of that channel; and spacers extending through the slots and connecting the plates, each spacer having a cam-shaped cross-section adapted to be in releasable frictional clamping engagement with the edges of its associated slot when the compressor is in the first position.

* * * * *